US005097853A

United States Patent [19]

Nehashi

[11] Patent Number: 5,097,853

[45] Date of Patent: Mar. 24, 1992

[54] EYELINER APPLICATOR

[75] Inventor: Hiroto Nehashi, Tokyo, Japan

[73] Assignee: Ikeda Industry Corporation, Japan

[21] Appl. No.: 548,427

[22] Filed: Jul. 5, 1990

Related U.S. Application Data

[63] Continuation-in-part of Ser. No. 374,903, Jun. 28, 1989, abandoned.

[30] Foreign Application Priority Data

Oct. 21, 1988 [JP] Japan ..... 63-263887
Mar. 29, 1989 [JP] Japan ..... 1-34829[U]

[51] Int. Cl.[5] ..... A45D 40/26

[52] U.S. Cl. ..... 132/320; 132/218; 401/126; 401/130; 401/198; 401/206

[58] Field of Search ..... 132/216, 218, 320, 317; 401/17, 18, 34, 119, 126, 130, 191, 202, 122, 127, 196, 198, 199, 205, 206

[56] References Cited

U.S. PATENT DOCUMENTS

| | | | |
|---|---|---|---|
| 2,673,362 | 3/1954 | Robinson | 401/202 |
| 2,703,898 | 3/1955 | Kellett | 401/122 |
| 3,341,884 | 9/1967 | Pryor | 401/202 |
| 3,369,543 | 2/1968 | Ronco | 401/202 |
| 3,549,266 | 12/1970 | Vasas | 132/218 |
| 3,592,202 | 7/1971 | Jones | 401/34 |
| 3,678,947 | 7/1972 | Ehrlich | 132/218 |
| 3,684,387 | 8/1972 | Glenn | 401/122 |
| 4,101,225 | 7/1978 | Linz et al. | 401/119 |
| 4,364,684 | 12/1982 | Kohno et al. | 401/206 |
| 4,452,262 | 6/1984 | Jankewitz | 132/320 |
| 4,509,875 | 4/1985 | Shintani | 401/202 |
| 4,627,454 | 12/1986 | Dahm | 132/320 |
| 4,643,605 | 2/1986 | Iwasaki | 401/202 |
| 4,880,326 | 11/1989 | Spivey et al. | 401/126 |

FOREIGN PATENT DOCUMENTS

| | | | |
|---|---|---|---|
| 2509978 | 9/1976 | Fed. Rep. of Germany | 401/202 |
| 2314686 | 1/1977 | France | 132/218 |
| 2445705 | 9/1980 | France | 401/202 |
| 1153019 | 11/1967 | United Kingdom | 401/202 |
| 2170696 | 8/1986 | United Kingdom | 132/320 |

*Primary Examiner*—John J. Wilson
*Assistant Examiner*—Frank A. LaViola
*Attorney, Agent, or Firm*—Armstrong, Nikaido, Marmelstein, Kubovcik & Murray

[57] ABSTRACT

Disclosed is an improved eyeliner applicator having a quantity of eyeliner-soaked material packed into the hollow space of its cap, whereby its felt tip is inserted into the eyeliner-soaked material when its cap is placed on its shank, thereby maintaining its tip wet with the eyeliner liquid. This arrangement permits automatic removal of dust from the tip surface every time the tip is inserted into the eyeliner-soaked material, thus maintaining the tip surface free of dust to assure a smooth supply of the eyeliner to the tip surface.

14 Claims, 4 Drawing Sheets

EYELINER APPLICATOR

This application is a continuation-in-part of application Ser. No. 374,903 filed June 28, 1989, now abandoned.

BACKGROUND OF THE INVENTION

1. Field of the Invention

The present invention relates to a cosmetic applicator, and more particularly to an eyeliner applicator.

2. Related Art

Eyeshadow, mascara, eyeliner and other cosmetics are used, and various applicators for applying these cosmetics have been proposed and actually used. FIGS. 10, 11 and 12 show different modes of a conventional eyeliner applicator. In detail, FIG. 10 is a longitudinal section of the eyeliner applicator with its cap removed. FIG. 11 is a side view of the eyeliner applicator with its cap placed on the rear end of the applicator body. FIG. 12 is a side view of the eyeliner applicator with its cap put on the front end of the applicator body. As shown in these figures, the eyeliner applicator comprises a tip member 1 of a porous material, a hollow shank 2 having a plug 3 fitted into the rear end of the shank, and being packed with a quantity of eyeliner-soaked material 6, and a cap 4 to be placed on the front end of the shank, thereby covering the tip member 1. The tip member 1 is like a tapering brush, and is made of felt, sponge or any other porous material which allows a permeation of a liquid. As shown, the front end of the shank body is reduced in diameter as indicated at 5 to hold the felt tip 1. The hollow shank 2 is packed with an absorbing material 6, which is soaked with an eyeliner composed of: water, butyleneglycol, oleic acid, naphthenic acid, sodium naphthenate, sodium dodecylbenzenesulfonate, sodium oleate, methyl-parabene, propyl parabene, ethylenediamine, disodium tetraacetate, iron oxide, bentonite, ultramarineblue, titanium dioxide, mica or any other pigment. As seen from FIGS. 10 and 11, a vent hole 7 is formed in the front end of the shank body. The open end of the hollow shank 2 is closed with a plug 3. The cap 4 can be detachably placed on either of the front end of the shank body 2 and the rear end of the plug 3. When in use, the cap 4 is removed from the front end of the shank body 2, and the applicator is used to outline the eye close to the lashes while the eyeliner permeates from the eyeliner-soaked material 6 to the felt tip 1.

The conventional eyeliner applicator has some drawbacks as described below:

Dust collecting on the felt tip end closes its capillaries, making it difficult for the eyeliner to ooze onto the surface of the felt tip.

In an attempt to prevent the propagation of bacteria in the eyeliner-soaked material, the eyeliner contains an antiseptic. However, an antiseptic which is strong enough to assure prevention of bacteria propagation cannot be used because such a strong antiseptic is likely to have an adverse effect on the skin. The Drugs, Cosmetics and Medical Instruments Act forbids the use of such a strong antiseptic. Therefore, less effective antiseptics such as methyl parabene or propyl parabene are used, which allows mold, bacteria or the like to partly cover the tip surface, thus making it difficult to supply a sufficient amount of cosmetic to the tip surface. Usually, pigments and other ingredients differ in mass, and are likely to separate in the mixture. Thus, the desired coloring cannot be achieved. This tendency is even more conspicuous when a plurality of pigments are used in the cosmetic.

In an attempt to facilitate the oozing of the pigment from the material 6 to the tip end, a vent hole 7 is made in the shank body 2 in the vicinity of the tip 1. An air channel must be provided along the full length of shank body from the front to rear end thereof. If a vent hole is made at a place other than where the vent hole is covered by the cap when it is placed on the front end of the shank body, this would allow the aqueous cosmetic to evaporate from the material in the hollow space of the shank body. The hollow space of the shank body cannot be completely packed with eyeliner-soaked material because an air channel must be left in the shank body.

To disadvantage the amount of eyeliner-soaked material cannot be increased without increasing the length of the hollow shank, for lengthening would expedite the separation of the pigments from other ingredients. Also, no conventional eyeliner applicator permits application of two different colors. Finally, cotton filaments are liable to catch pigment particles, and sometimes uneven coloring results.

SUMMARY OF THE INVENTION

With the above in mind, one object of the present invention is to provide an eyeliner applicator with a porous tip guaranteed to be free with mold, bacteria or the like even if a lesseffective antiseptic is used, thus assuring the smooth oozing of the aqueous cosmetic from the tip surface.

Another object of the present invention is to provide an eyeliner applicator of a shortened size, thereby decreasing the chances of separation of the pigment from other ingredients.

Still another object of the present invention is to provide an eyeliner applicator which permits application of two different colors.

Still another object of the present invention is to provide an eyeliner applicator which prevents the exposure of the eyeliner to air, hence minimizing oxidation of the cosmetic.

Still another object of the present invention is to provide an eyeliner applicator which prevents pigment particles from being caught by material filaments.

To attain these objects an eyeliner applicator according to one aspect of the present invention comprises: a tip member of a material which permits the permeation of an eyeliner liquid; a holder to hold said tip member; a shank attached to the rear end of said holder; and a hollow cap packed with an eyeliner-soaked material, whereby said tip member is inserted into said eyeliner-soaked material when said cap is placed on said holder, thereby maintaining said tip member wet with said eyeliner liquid.

According to another aspect of the present invention, an eyeliner applicator according to the present invention comprises two tip members each made of a material which permits the permeation of an eyeliner liquid; two holders to hold said tip members; a joint shank whose opposite ends are fixed to the rear end of each of said holders; and two hollow caps each packed with an eyeliner-soaked material, whereby each of said tip members is inserted into said quantity of eyeliner-soaked material when said caps are placed on said holders, thereby maintaining said tip members wet with said eyeliner liquid.

According to still another aspect of the present invention, an eyeliner applicator comprises a tip member of a material which permits the permeation of an eyeliner liquid; a holder to hold said tip member; a shank attached to the rear end of said holder; and a hollow cap containing a quantity of eyeliner liquid and having a plug membrane to prevent the exposure of said eyeliner liquid to the surrounding atmosphere, said plug membrane having cuts to allow said tip members to enter the hollow space of said cap, thereby maintaining said tip member wet with said eyeliner liquid.

Other objects and advantages of the present invention will be understood from the following description of preferred embodiments of the present invention shown in accompanying drawings.

BRIEF DESCRIPTION OF THE DRAWINGS

FIG. 5 is a longitudinal section of the eyeliner applicator of FIG. 4 with its caps placed on;

FIG. 7 is a side view of the eyeliner applicator of FIG. 6 with its cap removed; while FIG. 8 is an enlarged front view of a plug membrane which is to be fitted in the cap of the eyeliner applicator of FIG. 6; while FIG. 9 is an enlarged longitudinal section of the plug membrane; of the third embodiment while

PREFERRED EMBODIMENT OF THE INVENTION

Figure 1:
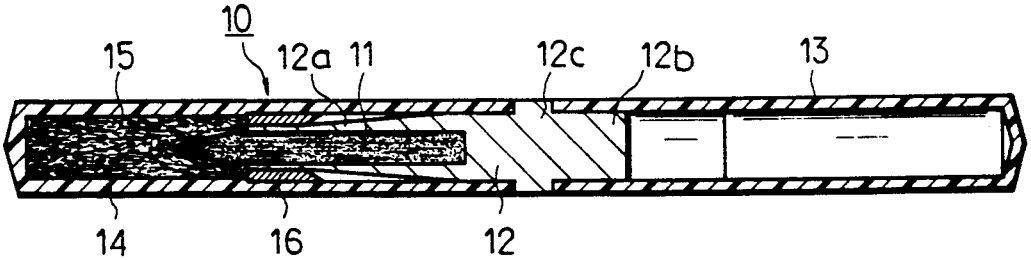
FIG. 1 is a longitudinal section of an eyeliner applicator according to a first embodiment of the present invention.
Figure 2:
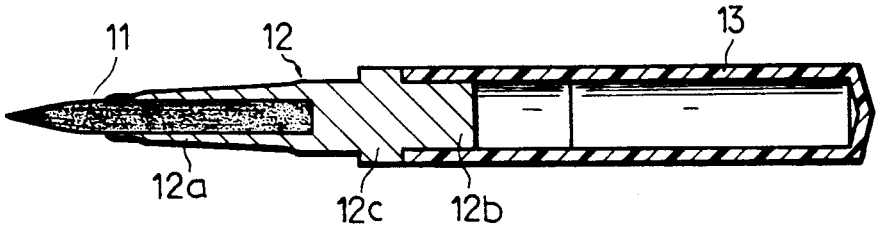
FIG. 2 is a longitudinal section of the eyeliner applicator of FIG. 1 with its cap removed.
Figure 3:
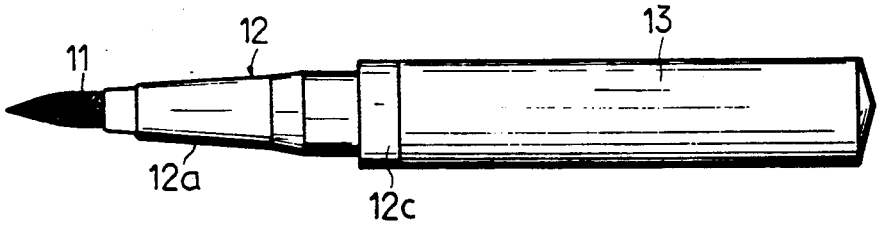
FIG. 3 is a side view of the eyeliner applicator of FIG. 1 with its cap removed.

Referring to FIGS. 1 to 3, an eyeliner applicator 10 according to the first embodiment of the present invention comprises a tapering tip member 11 of a material which permits the permeation of an eyeliner liquid, such as felt; a holder 12 to hold the tip member 11, a shank 13 attached to the rear end of the holder 12 and a hollow cap 14 which is packed with an eyeliner-soaking material 15 such as cotton, polypropylene fiber, polyethylene fiber, foamed polyurethane or the like. The tapering tip end 11 may be preferably made of polyurethane resin attached to a core of nylon fibers. The holder 12 has a tapering end 12*a* to grip the tip member 11, a collar 12*c* and a rear end 12*b* to permit the fitting of the hollow shank 13. The size of the hollow shank 13 may be determined so as to permit a user to hold the applicator with ease. The eyeliner comprises a pigment, water and antiseptic. With this arrangement, the tip member 11 will be inserted into the eyeliner-soaked material 15 when the cap 14 is placed on the holder 12 of the eyeliner applicator 10, thereby maintaining the tip member 11 wet with the eyeliner liquid.

As seen from FIG. 1, the cap 14 has a ring 16 fitted therein to prevent the cotton 15 from slipping out and at the same time, guide the tip member 11 during insertion. The material 15 absorbs an eyeliner which is mainly composed of water, butyleneglycol, oleic acid, naphthenic acid, sodium naphthenate, sodium dodecylbenzenesulfonate, or sodium oleate; and methyl parabene, propyl parabenean or any other antiseptic; titanium dioxide, xanthane gum, bentonite, mica or any other pigment.

While the eyeliner applicator is carried, the cap 14 is placed on the holder 12 of the applicator 10, thereby maintaining the tip member 11 wet with the eyeliner soaked in the material 15. When in use, the cap 14 is removed from the holder 12 of the applicator to expose the tip member 11 as shown in FIG. 3. After outlining the eye close to the lashes with the tip member 11 of the applicator, the cap 14 is placed on the holder 12 of the applicator so that the tip member 11 of the applicator is inserted into the eyeliner-soaked material 15, thereby removing dust from the tip member 11 of the applicator and at the same time, supplying the tip member 11 with as much eyeliner as was used. The tip member 11 of the applicator is completely inserted into the eyeliner-soaked material 15, and therefore propagation of bacteria can be effectively prevented even if a less effective antiseptic is used. Also, pigments of different masses in the eyeliner have little or no tendency to separate from each other in a length of material shortened in its longitudinal direction.

Figure 4:
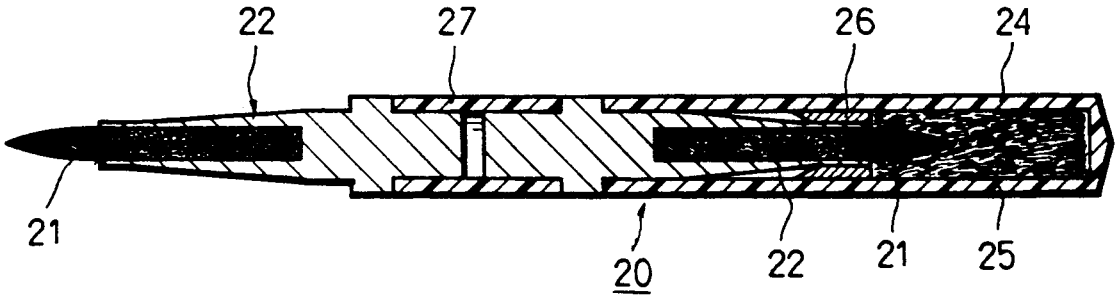
FIG. 4 is a longitudinal section of an eyeliner applicator according to a second embodiment of the present invention with one of its caps removed.
Figure 5:
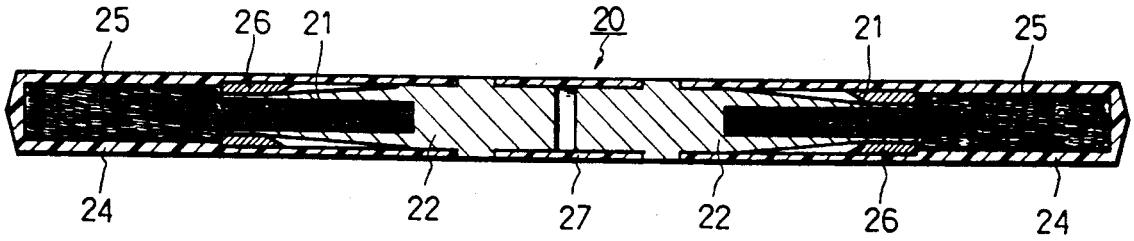

FIGS. 4 and 5 show an eyeliner applicator 20 according to the second embodiment of the present invention.

As seen from these drawings, the eyeliner applicator 20 comprises two tapering tip members 21 each made of a material which permits the permeation of an eyeliner liquid; two holders 22 to hold the tip members 21, a joint shank 27 whose opposite ends are fixed to the rear end of each of the holders 22, and two hollow caps 24 each packed with an eyeliner-soaked material 25. Each cap has a ring 26 similar to ring 16 in the first embodiment. Pigments of different colors are absorbed in each of the materials which are in the caps 24, 24 thus permitting a user to select the color of eyeliner to be applied to the user's eyes.

The use of a joint shank permits reduction of the size of a bicolor eyeliner applicator.

FIGS. 6 to 9 show an eyeliner applicator 30 according to the third embodiment of the present invention.

Figure 6:
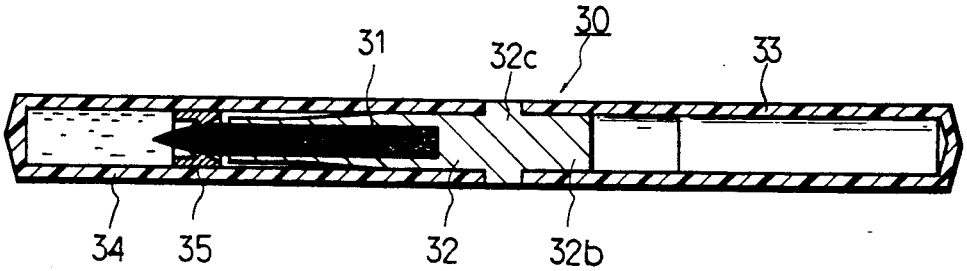
FIG. 6 is a longitudinal section of an eyeliner applicator according to a third embodiment of the present invention with its cap placed on and FIG. 6A shows a fourth embodiment.
Figure 7:
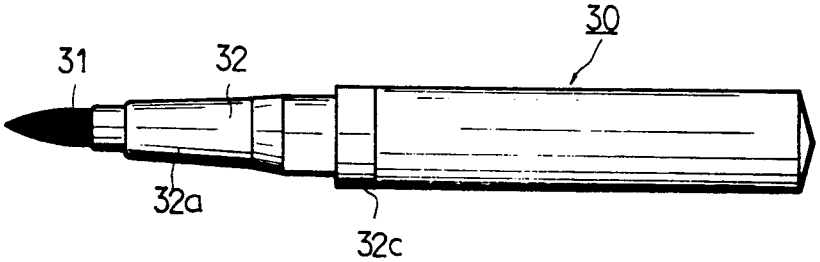
Figure 8:
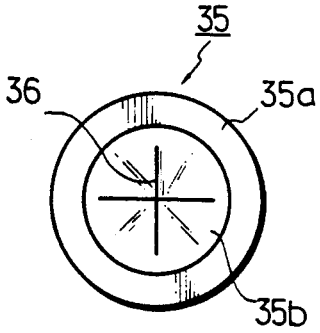
Figure 9:
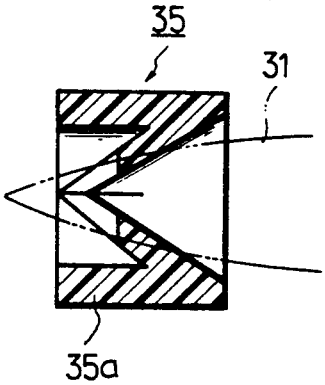

As seen from FIGS. 6 and 7, the eyeliner applicator 30 comprises a tapering tip member 31 of a material, such as felt which permits the infiltration of an eyeliner liquid, a holder 32 with a tapering end 32*a* to grip the tip member 3 and a collar 32*c* to hold the tip member 31, a shank 33 attached to the rear end 32*b* of the holder 32, and a hollow cap 34 containing a quantity of eyeliner liquid and having a plug membrane 35 to prevent exposure of the eyeliner liquid to the surrounding atmosphere. As seen from FIGS. 8 and 9, the plug membrane 35 is composed of a cylindrical wall 35*a* and a bottom membrane 35*b* integrally connected to one end of the hollow cylinder. The bottom membrane 35*b* of the plug membrane 35 has a crosscut 36 to allow the tip member 31 to enter the hollow space of the cap, thereby maintaining the tip member wet with the eyeliner liquid. When in use, the cap 34 is removed from the holder 32 of the applicator, thereby exposing the tip member 31 as shown in FIG. 7. At the same time, the bottom membrane 35*b* is able to close resiliently, thus preventing exposure of the eyeliner liquid to the surrounding atmosphere to eliminate deterioration of the eyeliner due to oxidation. After the eyeliner applicator is used, the cap 34 is placed on the holder 32 of the applicator. The plug membrane 35 can be opened due to the yieldingly bending action of the quarter flaps of the bottom 35*b* which permits insertion of the tip member 31 into the eyeliner contained in the hollow cap 34.

Due to the elimination of material in this particular embodiment, the eyeliner applicator is free from uneven outlining which might be caused by pigment particles being caught by filaments of the material.

It should be noted that the present invention should not be limited to the embodiments described above because they can be modified appropriately according to need. As for the first embodiment, the shank 13 can be omitted. In this case when the applicator is in use, the cap 14 would be fitted to the rear end of the holder 12 in place of the shank 13. This modification shortens the total length of the applicator. The tip member 11 can have a different shape other than that of a tapering tip.

FIGS. 6A, 7A, 8A, 8B and 9A show an eyeliner applicator 40 according to the fourth embodiment of the present invention, which is improved over the applicator 30.

Figure 6A:
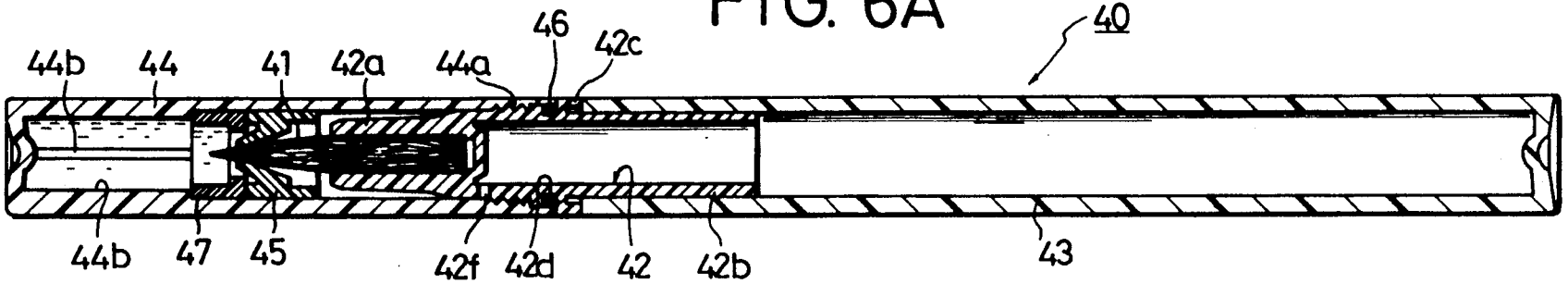
Figure 7A:
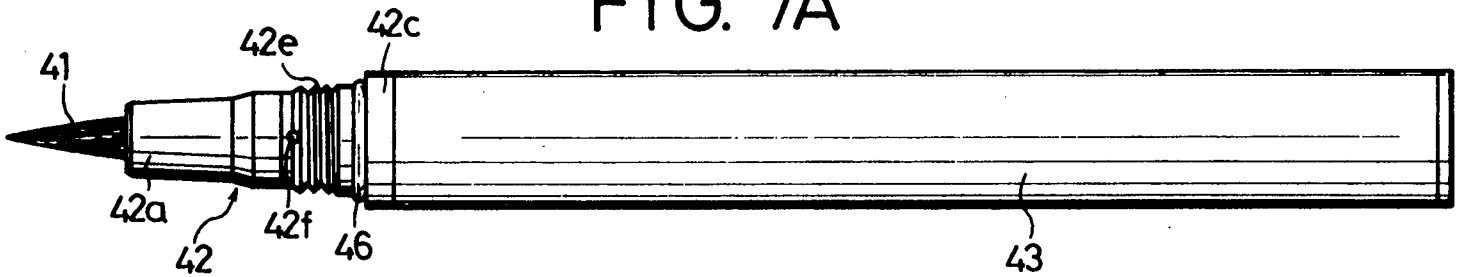
FIG. 7A shows FIG. 6A in side view
Figure 9A:
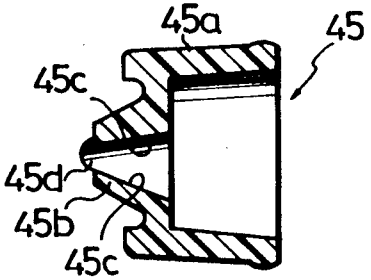
FIG. 9A shows the fourth embodiment
Figure 8B:
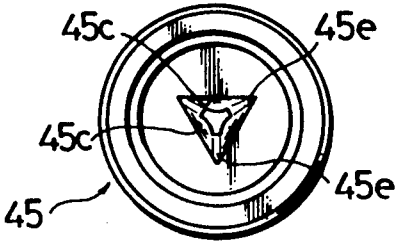
FIGS. 8A and 8B show the plug membrane 9 of FIG. 6A
Figure 8A:
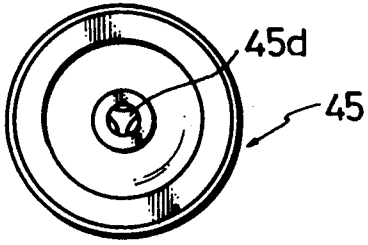
Figure 10:
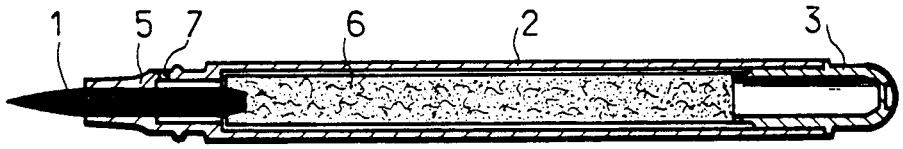
FIG. 10 PRIOR ART
FIG. 10 is a longitudinal section of a conventional eyeliner applicator with its cap removed.
Figure 11:
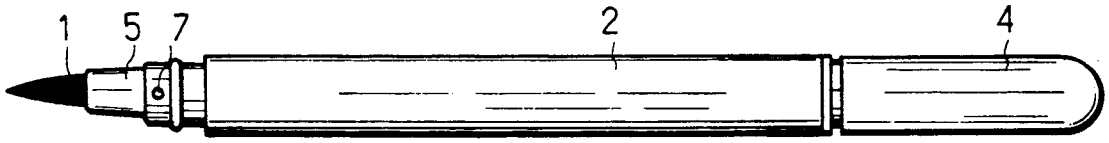
FIG. 11 PRIOR ART
FIG. 11 is a side view of the conventional eyeliner applicator with its cap placed on the rear end of the applicator.
Figure 12:
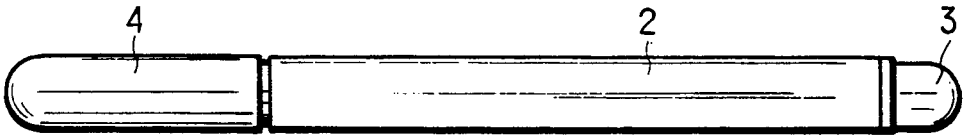
FIG. 12 PRIOR ART
FIG. 12 is a side view of the conventional eyeliner applicator with its cap placed on the front end of the applicator.

As seen from FIGS. 6A and 7A, the eyeliner applicator 40 comprises a tapering tip member 41 of a material, such as felt which permits the infiltration of an eyeliner liquid, a holder 42 to hold the tip member 41, a shank 43 attached to the rear end of the holder 42, and a hollow cap 44 containing a quantity of eyeliner liquid and having a plug membrane 45 to prevent outflow of the eyeliner liquid therefrom.

The holder 42 has a tapering end 42*a* to grip the tip member 41, a collar 42*c* and a rear end 42*b* to permit fitting of the hollow shank 43. The rear end 42*b* of the holder is hollow and opened in the hollow shank 43. A groove 42*d* is made on the circumference adjacent to the collar 42*c*, and an O-ring 46 is fitted therein for sealing a gap within the holder 42 and the cap 44. The holder 42 has a fine thread 42*e* formed in the vicinity of the groove 42*d*. An air passage hole 42*f* is made adjacent to the groove 42*d*. An air passage hole 42*f* is made adjacent to the thread end 42*e*, which communicates with the inner space of the hollow shank 43.

The hollow cap 44 has a fine thread 44*a* made at the inner wall in the vicinity of the open end to fit with the thread 42*e* of the holder 42. As shown in FIG. 6A, four stopper ribs 44*b* are protruded in parallel with each other on the inner wall of the head portion of the cap 44 to locate the plug membrane 45 at the predetermined position. The rib 44*b* may be an annular projection instead. A collar ring 47 is inserted between the ribs 44*b* and the plug membrane 45 to locate the plug membrane, completely preventing deformation due to its elasticity.

The plug membrane 45 is made of elastic material, for instance, rubber, synthetic rubber, synthetic resin or the like. As seen from FIGS. 8A, 8B and 9A, the plug membrane 45 is made of elastic composed of a cylindrical wall 45*a* and a bottom membrane 45*b* integrally connected to one end of the hollow cylinder. The bottom membrane 45*b* of the plug membrane 45 has triangular inner wall 45*c* to form a space in the form of trigonal pyramid and a nearly triangular small mouth 45*d* at its bottom end to allow the tip member 41 to enter the hollow space of the cap, thereby maintaining the tip member wet with the eyeliner liquid. The mouth 45*d* is small enough to prevent the eyeliner liquid from flowing out. It may be about 1–2 mm of diameter. The eyeliner liquid in the cap 44 would not flow out due to surface tension of itself.

When in use, the cap 44 is removed from the holder 42 of the applicator by loosening the engagement of the threads 42*e* and 44*a*, thereby exposing the tip member 41 as shown in FIG. 7A. At the same time, the mouth 45*d* of bottom membrane 45*b* returns to its normal diameter, due to elasticity, from the diameter which is enlarged and deformed to a round shape due to insertion of the tip member 41. Thus, by having the mouth 45*d* return to its normal shape, the eyeliner liquid is prevented from flowing out of the mouth 45*d*. On loosening the engagement of the threads 42*e* and 44*a*, the tip member 41 gently slips away from the mouth 45*d* with excessive eyeliner liquid, infiltrated in the tip member, being wiped by the mouth. At the same time, air flows into the hollow space of the cap 44, containing the eyeliner liquid, and passes through the gap formed between the tip member 41 and the inner wall 45*c* at each ridgeline 45*e* of the trigonal pyramid space, thereby preventing the occurrence of a negative pressure in the hollow space of the cap 44 so that the eyeliner liquid is not sprayed out through the mouth 45*d*. Also, the air passage hole 42*f* prevents occurrence of a negative pressure in the cap during removal of the holder 42 from the cap 44.

After the eyeliner applicator is used, the cap 44 is threaded onto the holder 42 of the applicator. The tip member 41 can be inserted into the eyeliner containing hollow cap 44 through the trigonal pyramid space of the bottom member 45*b* by sliding through and expanding the mouth 45*d*.

From the foregoing description of the preferred embodiment of the invention, it will be apparent that many modifications may be made therein. It should be understood that these embodiments are intended as one example of the invention only, and that the invention is not limited thereto. Therefore, it should be understood that the appended claims are intended to cover all modifications that fall within the true spirit and scope of the invention.

What claimed is:

1. An eyeliner applicator comprising:

a tip member of a material which permits permeation of an eyeliner liquid;

a holder to hold said tip member;

a shank attached to a rear end of said holder; and a hollow cap containing a quantity of eyeliner liquid and having an elastic plug membrane inside said hollow cap to prevent outflow of said eyeliner liquid from the hollow cap, said plug membrane having a bottom membrane with an inner wall which forms a trigonal pyramid space having ridgelines and said bottom membrane having a nearly triangular small mouth which is deformable at a bottom end of said inner wall to allow said tip member to enter the hollow space of said cap, therein maintaining said tip member wet with said eyeliner liquid, said triangular small mouth allowing air to flow into and out of said cap along a gap formed at each ridgeline of said trigonal pyramid space when said tip is inserted in said plug member preventing negative pressure in said cap.

2. A eyeliner applicator according to claim 1 wherein said holder and said hollow cap are threadedly fitted.

3. An eyeliner applicator according to claim 2 wherein said shank is hollow, said holder having a hollow rear end which is opened in the hollow shank and an air passage hole which communicates with the hollow shank.

4. An eyeliner applicator according to claim 3 further comprising an O-ring provided on the holder for sealing a gap between the holder and the cap.

5. An eyeliner applicator according to claim 1 wherein said hollow cap further comprises a collar ring located at one end of the plug membrane to prevent deformation of said elastic plug membrane.

6. An eyeliner applicator according to claim 1 wherein said triangular small mouth being deformed to a round shape when said tip member is inserted therein.

7. An eyeliner applicator according to claim 1 wherein said triangular small mouth presses on said tip member when said tip member is withdrawn from said plug membrane, wherein excessive eyeliner liquid infiltrated in said tip member is wiped by said mouth.

8. An eyeliner applicator according to claim 1 wherein said triangular small mouth having a size, when said tip member is not inserted therein, which prevents said eyeliner liquid from flowing out.

9. An eyeliner applicator according to claim 8 wherein said size of said triangular small mouth is 1 to 2 mm.

10. An eyeliner applicator comprising:

a tip member of a material which permits permeation of an eyeliner liquid;

a holder to hold said tip member;

a shank attached to a rear end of said holder; and a hollow cap containing a quantity of eyeliner liquid and having an elastic plug membrane to prevent outflow of said eyeliner liquid from the hollow cap, said plug membrane having a cylindrical wall fixedly fitted within the hollow cap and having a bottom membrane with an inner wall which forms a trigonal pyramid space having ridgelines and said bottom membrane having a nearly triangular small mouth at a bottom end of said inner wall to allow said tip member to enter the hollow space of said cap, therein maintaining said tip member wet with said eyeliner liquid, said triangular small mouth allowing air to flow into and out of said cap along a gap formed at each ridgeline of said trigonal pyramid space when said tip is inserted in said plug member preventing negative pressure in said cap.

11. An eyeliner applicator according to claim 10 wherein said triangular small mouth being deformed to a round shape when said tip member is inserted therein.

12. An eyeliner applicator according to claim 10 wherein said triangular small mouth presses on said tip member when said tip member is withdrawn from said plug membrane, wherein excessive eyeliner liquid infiltrated in said tip member is wiped by said mouth.

13. An eyeliner applicator according to claim 10 wherein said triangular small mouth having a size, when said tip member is not inserted therein, which prevents said eyeliner liquid from flowing out.

14. An eyeliner applicator according to claim 13 wherein said size of said triangular small mouth is 1 to 2 mm.

* * * * *